US005596916A

United States Patent [19]

Gallagher et al.

[11] Patent Number: 5,596,916

[45] Date of Patent: Jan. 28, 1997

[54] METHOD FOR PREVENTING JAMS IN A TAPE EJECTING APPARATUS

[75] Inventors: Dennis M. Gallagher, Danbury; John R. Nobile, Fairfield, both of Conn.

[73] Assignee: Pitney Bowes Inc., Stamford, Conn.

[21] Appl. No.: 203,130

[22] Filed: Feb. 28, 1994

[51] Int. Cl.[6] ..... B26D 5/28

[52] U.S. Cl. ..... 83/23; 83/74; 83/367; 83/372; 83/950

[58] Field of Search ..... 83/23, 358, 363, 83/61, 73, 74, 950, 27, 367, 372, 370

[56] References Cited

U.S. PATENT DOCUMENTS

| | | | |
|---|---|---|---|
| 4,013,357 | 3/1977 | Nakajima et al. | 83/111 |
| 4,694,714 | 9/1987 | Focke et al. | 83/23 |
| 4,798,116 | 1/1989 | Silver et al. | 83/858 |
| 5,072,639 | 12/1991 | Dolf | 83/72 |
| 5,287,802 | 2/1994 | Pearson | 83/61 |

*Primary Examiner*—Kenneth E. Peterson
*Attorney, Agent, or Firm*—Steven J. Shapiro; Melvin J. Scolnick

[57] ABSTRACT

A method for sequencing the exiting of a cut tape segment from a tape roll feeding, cutting and ejecting apparatus of a mailing machine having a tape roll drive and cut tape segment ejection device and in which a cut tape segment from the tape roll is ejected in an opposite direction from the feeding direction of the feeding of tape of the tape roll drive as it feeds the tape for printing includes the steps of feeding the tape in the feeding direction for a first predetermined time period for extending a predetermined length of tape, further feeding the tape in the feeding direction to create a trail edge margin to assure that the tape is not cut shorter than a minimum length, printing on the tape; then feeding the tape in the opposite direction until one of a first and second conditions occurs, the first condition being the sensing of a leading edge of the tape by a sensor and the second condition being feeding the tape in the opposite direction beyond a second predetermined time period, then at times when the first condition occurs cutting the tape with a cutting apparatus to create the cut tape segment and subsequently ejecting the tape segment from the roll tape feeding, cutting and ejecting apparatus, and at times when the second condition occurs feeding the tape in the tape feed direction to alleviate a tape jam condition.

3 Claims, 10 Drawing Sheets

ROLL TAPE EXIT PROCEDURE

300
OUT OF TAPE?
YES
NO
CONTINUE TO ADVANCE 500 MSEC
302
SHORT MOTOR TIME = 0
304
STOP TAPE MOTOR SET ERROR
306
ENTER ERROR STATE
308
310
ADD TRAIL ADJUST TO LENGTH
312
INSURE MINIMUM LENGTH
314
REVERSE TAPE MOTION SLOW
316
MOVED 1/2 IN?
YES
NO
318
SET SPEED TO FULL
320
TAPE ERROR?
YES
NO
322
STOP TAPE STATE = STOP
324
TIME OUT?
NO
YES
326
TRIP SENSOR BLOCKED?
NO
YES
2A
2B

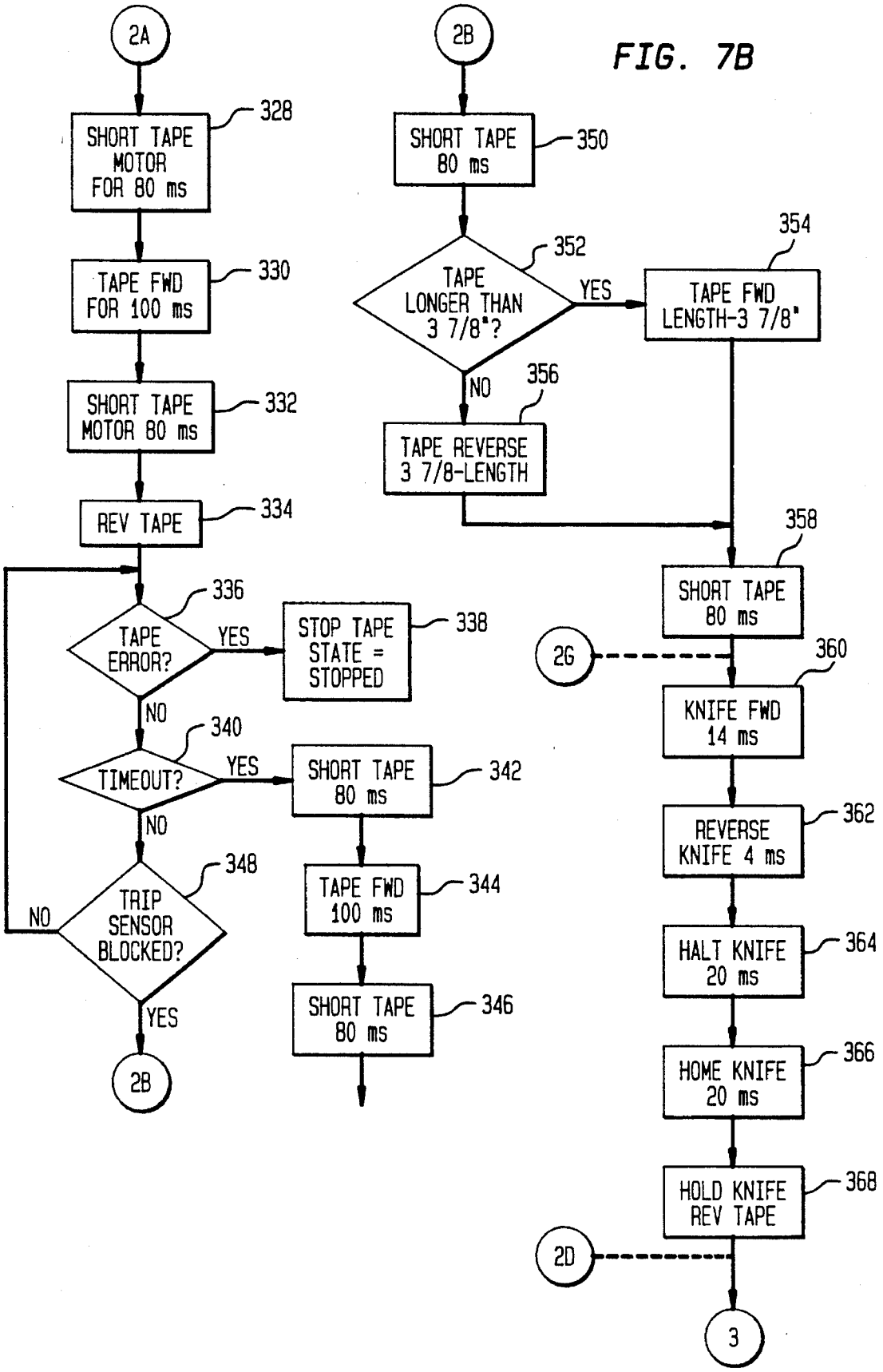
FIG. 7B
2A
SHORT TAPE MOTOR FOR 80 ms
328
TAPE FWD FOR 100 ms
330
SHORT TAPE MOTOR 80 ms
332
REV TAPE
334
TAPE ERROR?
336
YES
STOP TAPE STATE = STOPPED
338
NO
TIMEOUT?
340
YES
SHORT TAPE 80 ms
342
NO
TAPE FWD 100 ms
344
SHORT TAPE 80 ms
346
TRIP SENSOR BLOCKED?
348
NO
YES
2B
2B
SHORT TAPE 80 ms
350
TAPE LONGER THAN 3 7/8"?
352
YES
TAPE FWD LENGTH-3 7/8"
354
NO
356
TAPE REVERSE 3 7/8-LENGTH
358
SHORT TAPE 80 ms
2G
360
KNIFE FWD 14 ms
REVERSE KNIFE 4 ms
362
HALT KNIFE 20 ms
364
HOME KNIFE 20 ms
366
HOLD KNIFE REV TAPE
368
2D
3

METHOD FOR PREVENTING JAMS IN A TAPE EJECTING APPARATUS

FIELD OF THE INVENTION

The invention relates to mailing machines and more particularly tape dispensing units associated with the mailing machines.

BACKGROUND OF THE INVENTION

This application is one of the following five related patents and applications concurrently filed directed to a tape feeding, cutting and ejecting apparatus for a mailing machine: Ser. No. 08/203,132, now U.S. Pat. No. 5,539,287 for Roll-Tape Knife Control for a Tape-Cutting Apparatus in a Mailing Machine; U.S. Pat. No. 5,452,214 for Method for Initializing a Tape Feeding, Cutting and Ejection Apparatus for a Mailing Machine; Ser. No. 08/203,459, now U.S. Pat. No. 5,539,052 for Method for Controlling Speed in a Tape Feeding, Cutting and Ejection Apparatus for a Mailing Machine; Ser. No. 08/203,461 for Method for Control of Length of Imprint for a Mailing Machine; and, U.S. Pat. No. 5,415,484 for Method and Apparatus for Cutting Mailing Machine Roll Tape, all assigned to the assignee of the present invention.

In addition it is related to the following U.S. Pat. Nos.: 5,392,703; 5,392,704; and 5,390,594; all assigned to the assignee of the present invention.

Mailing machines are well known. Generally, mailing machines comprise a postage meter for printing an indicia on a piece of mail or on a tape and a feed base for transporting mailpieces or tapes for printing by the postage meter. Tape feeding mechanisms have typically not been incorporated into small mailing machines because of the costs involved. There are additional considerations in the design of these machines. One of the problems to be dealt with is the lack of access to the tape paths in a mailing machine. Typically any tape jams in these areas cannot be cleared by the operator and therefore require a service call.

U.S. Pat. No. 4,611,736 describes a mechanical device for feeding tape strips which includes a prevention means for preventing successive feeding of tape strips unless a lever has been returned to a predetermined position. U.S. Pat. No. 5,174,824 describes a tape feeding mechanism which utilizes a solenoid actuation for increasing the receiving aperture of the tape guide in order to prevent jams.

SUMMARY OF THE INVENTION

It has been found that one way to avoid many of the problems associated with possible tape jams is to provide an exit sequence which assures that a cut tape has been ejected and to assure that all appropriate conditions are always met to allow the cut tape segment to properly eject.

It is therefore an object of the invention to provide an exit routine to limit the opportunity for tape jams during the ejection process.

These and other objects are attained in a novel method for sequencing the exiting of a cut tape from a roll tape feeding, cutting and ejecting apparatus of a mailing machine having a roll tape drive and cut tape ejection means and in which a cut tape segment from the tape roll is ejected in an opposite direction from the feeding direction of the feeding of tape of the tape roll drive as it feeds the tape for printing, the method comprising the steps of setting a predetermined time for length of tape, adding a trail edge margin to assure that the tape is not cut shorter than a minimum length, reversing the tape drive to unblock a sensor for determining a position of a leading edge of the tape from the tape roll, and in the event that the sensor fails to become unblocked, reversing the direction of the tape roll and feeding the roll for a predetermined length to alleviate a jam condition and thereafter retrying the exiting procedure.

BRIEF DESCRIPTION OF THE DRAWING

FIG. 7*a* through 7*d* comprise a flow chart of the exiting sequence in accordance with the invention.

DESCRIPTION OF THE PREFERRED EMBODIMENT

Figure 1:
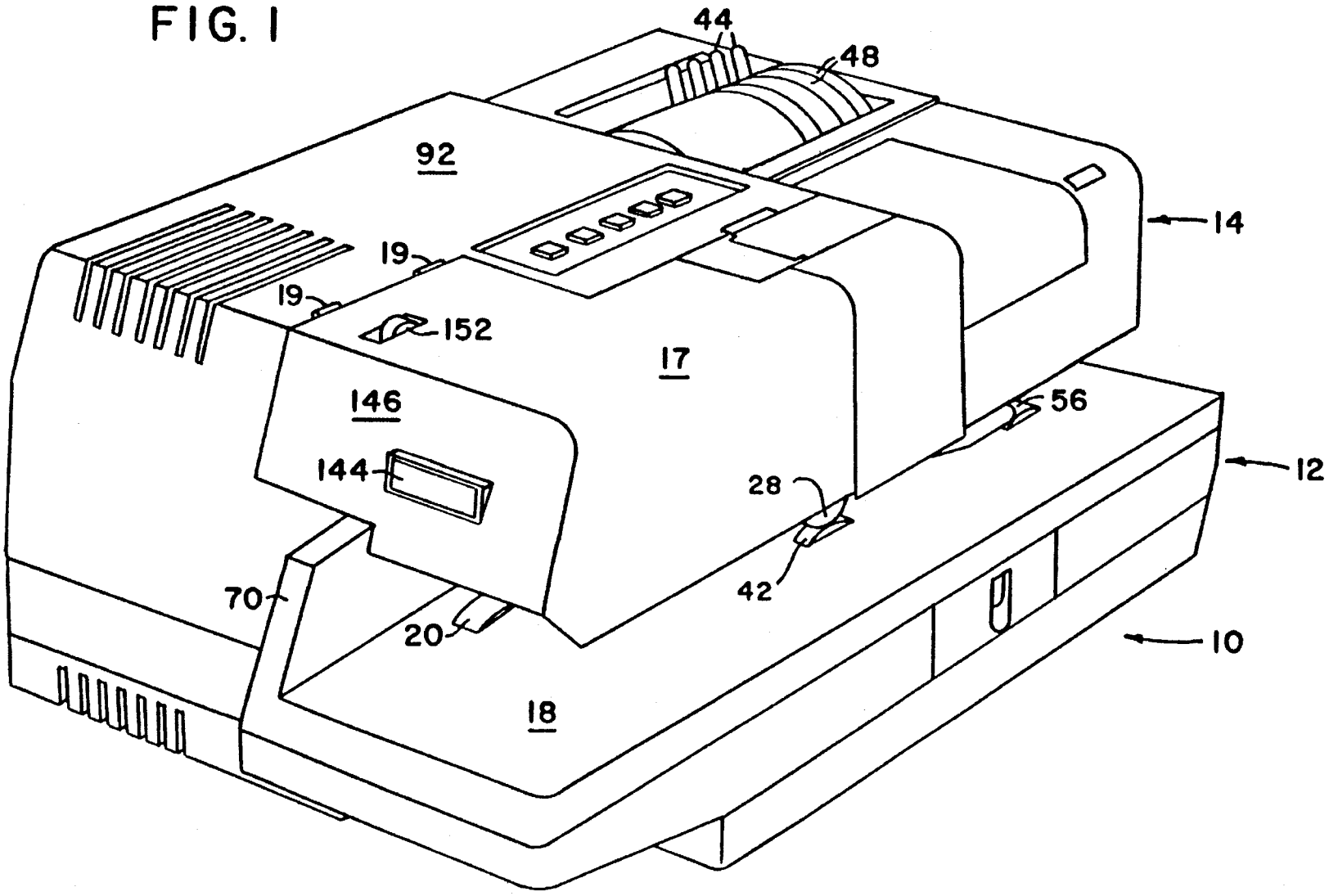
FIG. 1 is a general perspective view of a mailing machine embodying the present invention.
Figure 2:
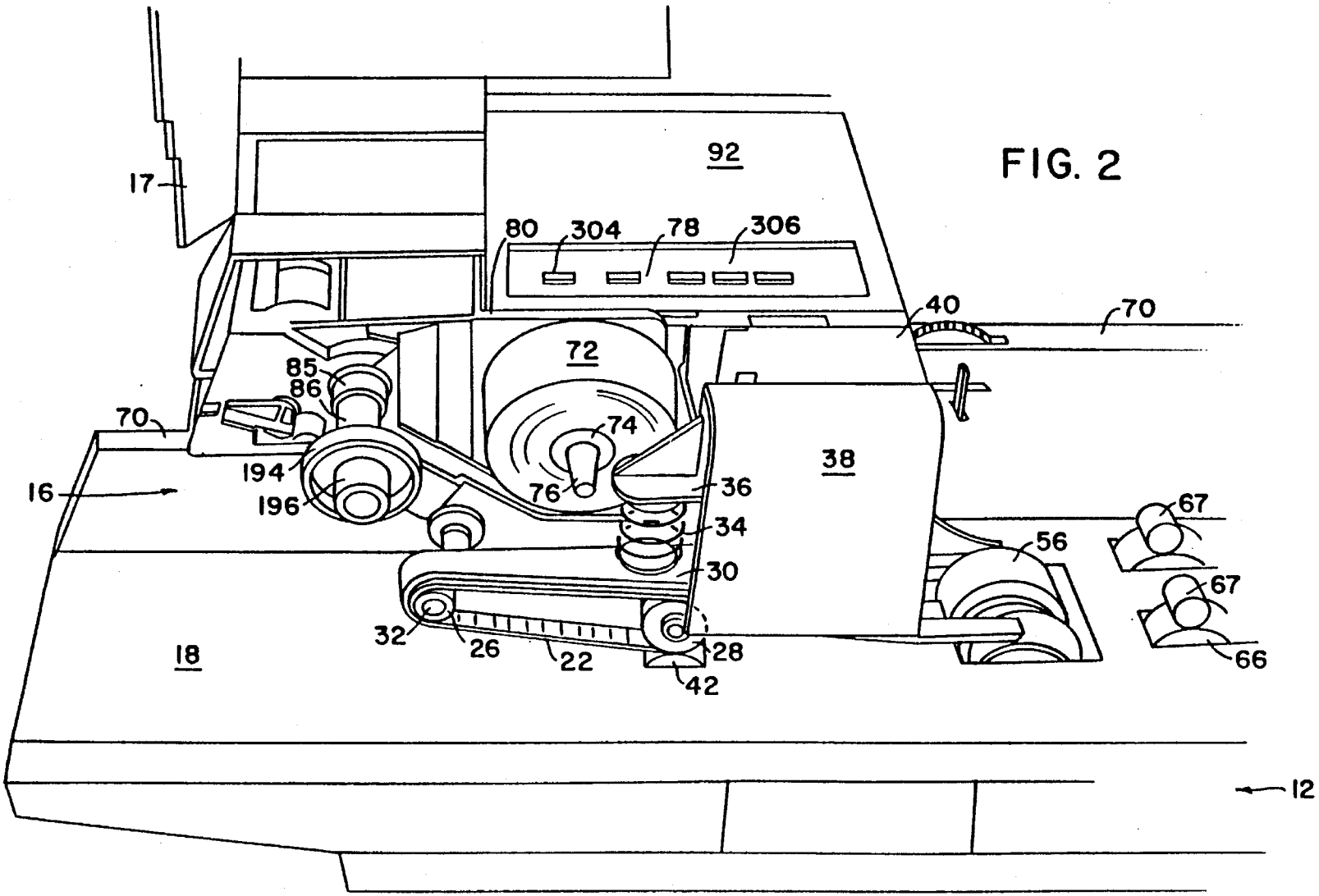
FIG. 2 is a frontal perspective view of the mailing machine shown in FIG. 1 with some covers removed to expose details.

In FIGS. 1 and 2, there is shown generally at 10 a a mailing machine as described generally in U.S. Pat. Nos.: 5,392,703; 5,392,704; and 5,390,594; each assigned to the assignee of the present invention and incorporated herein by reference.

The mailing machine includes a base shown generally at 12, a postage meter generally designated at 14, and a tape feeding, cutting, and ejection apparatus shown generally at 16 (FIG. 2). The mailing machine preferably includes a housing having a pivoted cover 17 connected by hinges 19 which can be raised to provide access.

The base 12 comprises a feed deck 18 which extends through the mailing machine 10 for support of mailpieces. Feeding rollers 20 project upward through the deck for engaging the underside of the mailpieces while belt 22 which extends around drive pulley 26 and idler pulley 28 serves to engage the upper surface for transporting the mailpiece for feeding to the postage meter. The outer surface of belt 22 passing around idler pulley 28 is mounted on elongate housing 30 which is pivoted about shaft 32 which drives the pulley 26. Housing 30 is spring loaded downwardly by spring 34 on bracket 36 formed on ink cartridge housing 38 which holds a removable ink cartridge 40. Belt 22 engages an idler roller 42 mounted beneath the feed deck 18 which acts as a pressure backup to ensure proper feeding of mailpieces between the belt 22 and idler roller 42.

Figure 3:
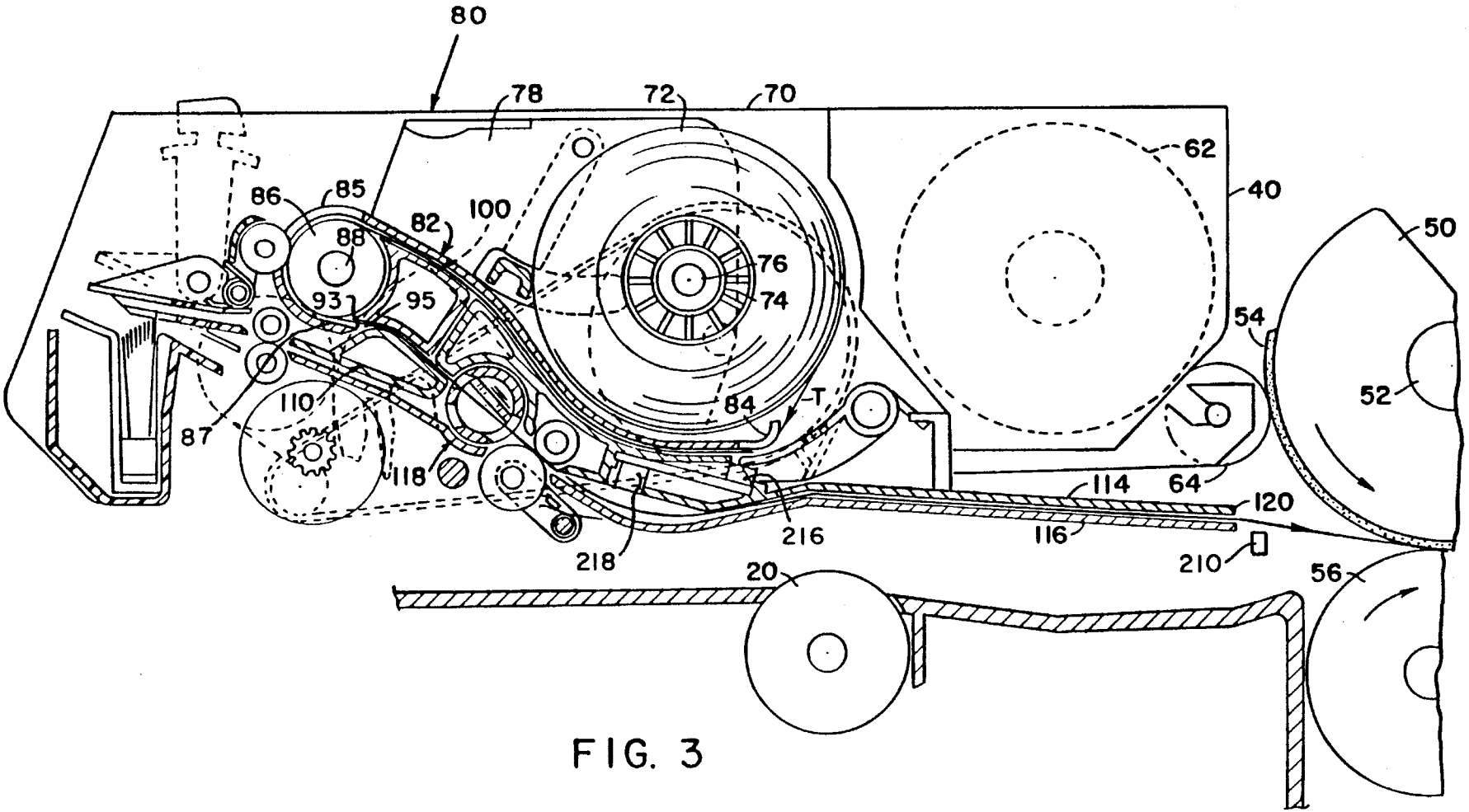
FIG. 3 is a view of the tape feeding, cutting and ejecting apparatus shown in place in the mailing machine.

Postage meter 14 has a plurality of setting levers 44 for setting postage in accordance with numerals on scales 48. As seen in FIG. 3 the postage meter includes print drum 50 mounted on shaft 52 which is driven for rotation of the drum. Drum 50 carries a printing die 54 for printing the indicia on a mailpiece pressed into firm engagement by impression rollers 56. The ink cartridge 40 contacts spring loaded transfer roller 64 for transferring ink to the printing die 54 on each revolution of the printing drum.

Returning to FIG. 2, the base further includes a plurality of eject rollers 66 and cooperating spring loaded pressure rollers 67 for conveying the mailpiece to the end of the feed deck.

Figure 4:
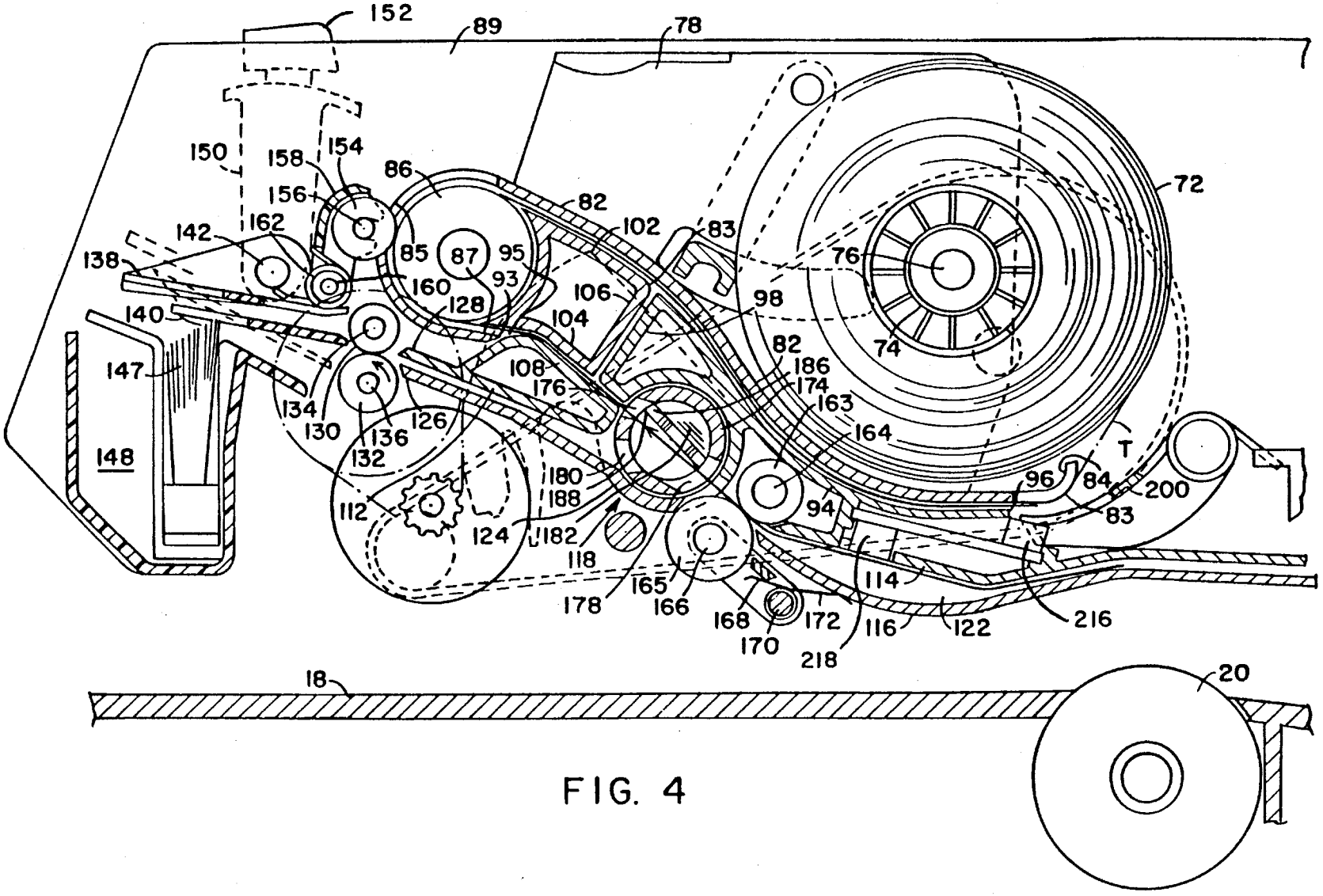
FIG. 4 is a view similar to FIG. 3 but drawn to enlarged scale and partly in longitudinal section to reveal particular details.

Referring now to FIGS. 3 and 4, the base 12 includes a wall 70 (also in FIGS. 1 and 2). The tape feeding, cutting and ejection apparatus 16 is mounted on the wall 70. Apparatus 16 includes a roll of tape 72 suitably mounted on spindle 74 which in turn is mounted on tape holding means which includes stub shaft 76 fixed to an upstanding wall 78 of a movable mounting frame designated generally at 80.

The mounting frame 80 also includes an upper guide plate 82 and has an upturned lip 84 which forms an entrance guide for the strip of tape "T" as it comes off the roll. The upper guide plate terminates in a pair of spaced apart U-shaped portions 85 which fit closely around the outer periphery of a drum shaped tape feed roller 86 fixedly mounted on shaft 88.

As best seen in FIG. 4, the strip is threaded through slot 83 formed formed by the lower surface of the upper guide plate 82 and guide wall 102. The U-shaped portions terminate in a flat portion 87 which is tapered to form a cutting edge 93 past which the free end of tape T is pulled , after it exits through slot 95 defined by edge 93 and guide wall 104. The lower guide plate 94 is disposed contiguously with guide plate 82 over most of its length commencing at end 96 and extending to wall 98.

An upper intermediate guide portion indicated at 100 is arranged in the space between wall 98 and tape feed roller 86 and includes the guide walls 102 and 104 and an upright wall 106 between the walls 102 and 104. The lower guide wall 104 is disposed in close relationship with an upper guide wall 108 of a lower intermediate guide portion designated by 110. This intermediate portion 110 has a lower guide wall 112.

A second set of guide plates 114 and 116 extend generally from a point adjacent a severing mechanism 118 to another point 120 adjacent the nip of the printing drum 50 and the impression roller 56. There is a short span where these guide plates are separated by a substantially larger distance to form a gap 122. The foregoing plates all define a first feed path for the tape.

Another elongate guide plate 124 extends rearwardly from beneath the severing mechanism 118 to an opposite end 126 The lower guide wall 112 of the intermediate guide portion 110 also has an end 128 located adjacent to the end 126 of the guide plate 124. A pair of feed rollers 130 and 132 are mounted on shafts 134 and 136 respectively.

On the opposite side of the feed rollers 130 and 132 is a tape deflector having closely spaced apart upper and lower guide plates 138 and 140 which are suitably connected together to form an integral unit which is fixedly mounted on on shaft 142. The deflector plates 138 and 140 lead to an outlet opening 144 (FIG. 1) formed in the side wall 146 of the cover. Lever 150 is suitably connected to shaft 142 and terminates upwardly in in a finger button 152 which projects through a top wall 92 to allow the operator to oscillate the shaft 142 back and forth to move the deflector plates 138 and 140 between the solid lines and dotted line position seen in FIG. 4. It will be noted that with the plates in the solid line position, a cut piece of tape is directed under the deflector plate 140 and over the top of the bristles 147 of moistening device 148. If in the dotted position, the deflector plates prevent the tape from being moistened and it is sent directly to the opening 144.

The tape feeding means comprises tape feed roller 86 and idler roller 154 which is rotatably mounted on shaft 156 fixed in frame 158, which in turn is pivotally mounted on shaft 160. Coil spring 162 is wrapped around the shaft 160 so that the ends bear against the frame 158 and the upper surface of deflector plate 138 to urge the frame 158 toward the feed roller 86, and thereby pressing the idler roller 154 into firm engagement with the tape as it passes around the feed roller 86.

Another feed roller 163 is fixedly mounted on a shaft 164 which is rotatably mounted in the frame. A pair of backup idler rollers 165 are mounted on shaft 166 which is rotatably mounted in frame 168 which in turn is pivotally mounted on another shaft 170 which is mounted on the frame walls. Coil spring 172 is mounted on the shaft 170 to urge the idler roller 165 toward the feed roller 163 to provide firm driving engagement between the feed roller 163 and the tape.

It will be appreciated that the feed roller 86 and backup idler roller 158, the feed roller 163 and backup idler roller 165 are all in the first path and serve both to feed the tape and to bring it back to the point where the tape is severed. The set of feed rollers 130 and 132 are disposed in a second path for ejecting the severed piece of tape.

The severing mechanism 118 comprises a cylindrical tubular member 174. This member has a plurality of axially elongate slots through which the tape passes, both in forward and reverse movements. Slot 176 provides an entrance for the tape and a second slot 178 provides an exit. A third slot 180 is formed on the same side as slot 176 to provide an exit for the severed portion of the tape and to direct the tape into the second feed path for ejection of the tape.

A movable cutting member or knife 182 is rotatably mounted in the tubular member 174, the cutting member having a close tolerance fit within the member 174. The knife 182 has a flat surface 186 which is angled slightly and defining a sharpened edge 188 which functions as a moveable blade for cutting the tape when the cutting member 182 is rotated. When the blade moves, it not only severs the tape but depresses the leading edge of the cut piece of tape to the lower slot 180 to direct the cut piece into the second path.

The drive mechanism is implemented suitably with a DC reversing motor (not seen in these figures) as described in connection with U.S. Pat. Nos. 5,392,704, previously incorporated by reference herein. The result of the operation is that a tape is fed to the postage meter for imprinting along a first path and then the tape is reversed and the appropriate strip length is severed and the severed tape strip is ejected along the second path. The complete operation is described in this referenced application and will not be further described herein except as required for the discussion of the present invention.

Figure 5:
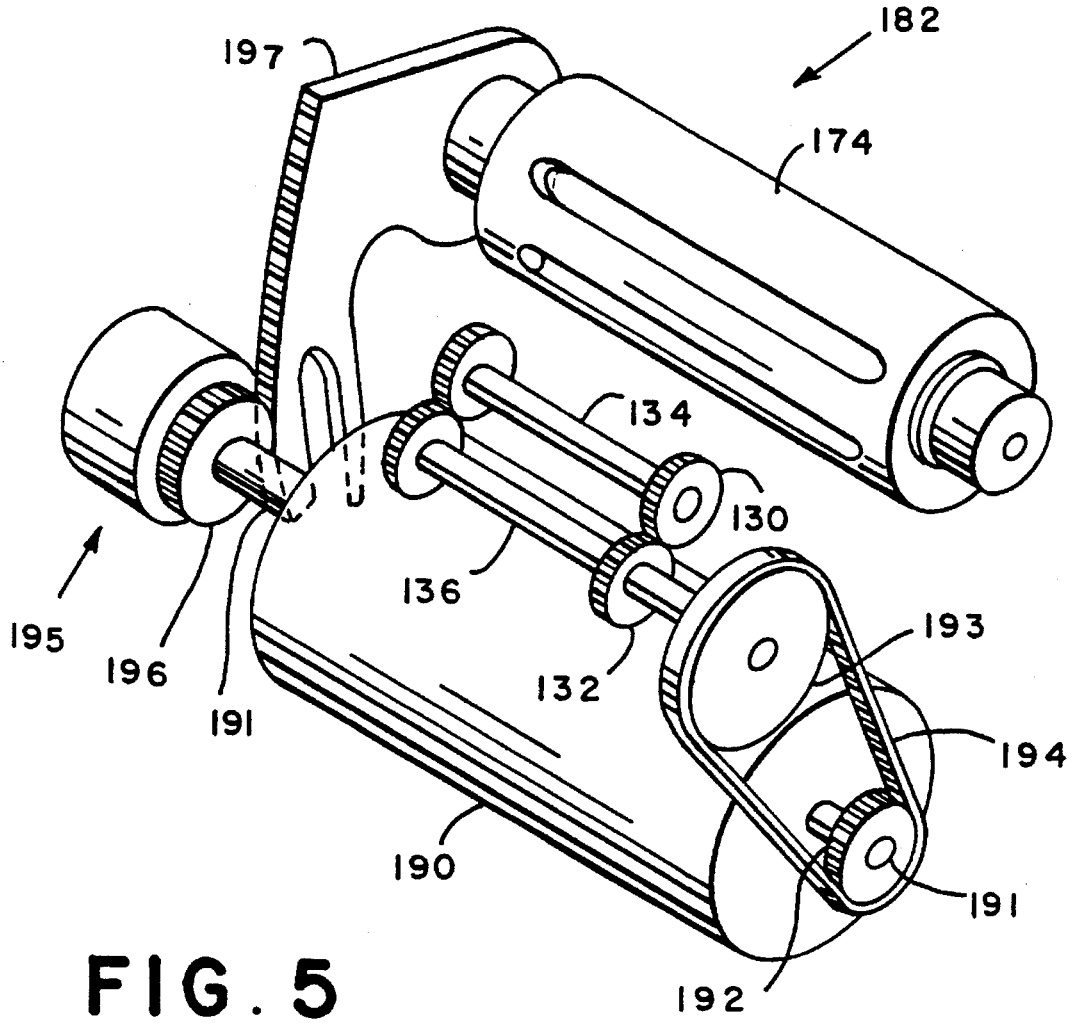
FIG. 5 is a perspective view of the rotary drive and knife mechanism of which operates the knife and exit feed rollers.

FIG. 5 is a perspective view of the rotary knife and drive mechanism which operates the knife and the feed rollers. As seen here, motor 190 is suitably mounted beneath guide plate 124. The motor has a drive shaft 191 which extends outwardly from both ends of the motor, one end operating the tape severing mechanism 118 and the other end operating the feed rollers 132, both in the manner to be described.

Timing gear 192 is rotatably mounted on the shaft 191, with a one-way friction clutch interposed so that the shaft 191 is in driving engagement with gear 192 only when the shaft is rotating in one direction. Another timing gear 193 is fixedly mounted on shaft 136 which carries the tape feed rollers 132. Timing belt 194 extends about gears 191 and 193 to drive the tape feed rollers 132 to feed the severed tape along the second feed path to exit the machine. When the motor is reversed to drive the shaft in the opposite direction, the one-way clutch prevents the gear 192 from being driven which in turn prevents the feed roller 132 from being driven in order to avoid pulling any pieces of tape back into the apparatus. The other end of shaft 191 is connected to a clutching device indicated at 195 and functions to control the oscillatory movement of the severing mechanism 118.

Gear 196 meshes with gear segment 197 such that arcuate motion of the gear segment 197 causes corresponding rotation of the cutting member 186 (FIG. 4) in the same direction. The clutching device 195 comprises two wrap spring clutches which operate to allow the motor 190 to drive the segment 197 in both directions. Further details are available from applications Ser. No. 180,161 and Ser. No. 180,168 for Tape Feeding, Cutting and Ejecting Apparatus for a Mailing Machine previously incorporated by reference and will not be further described here.

Figure 6:
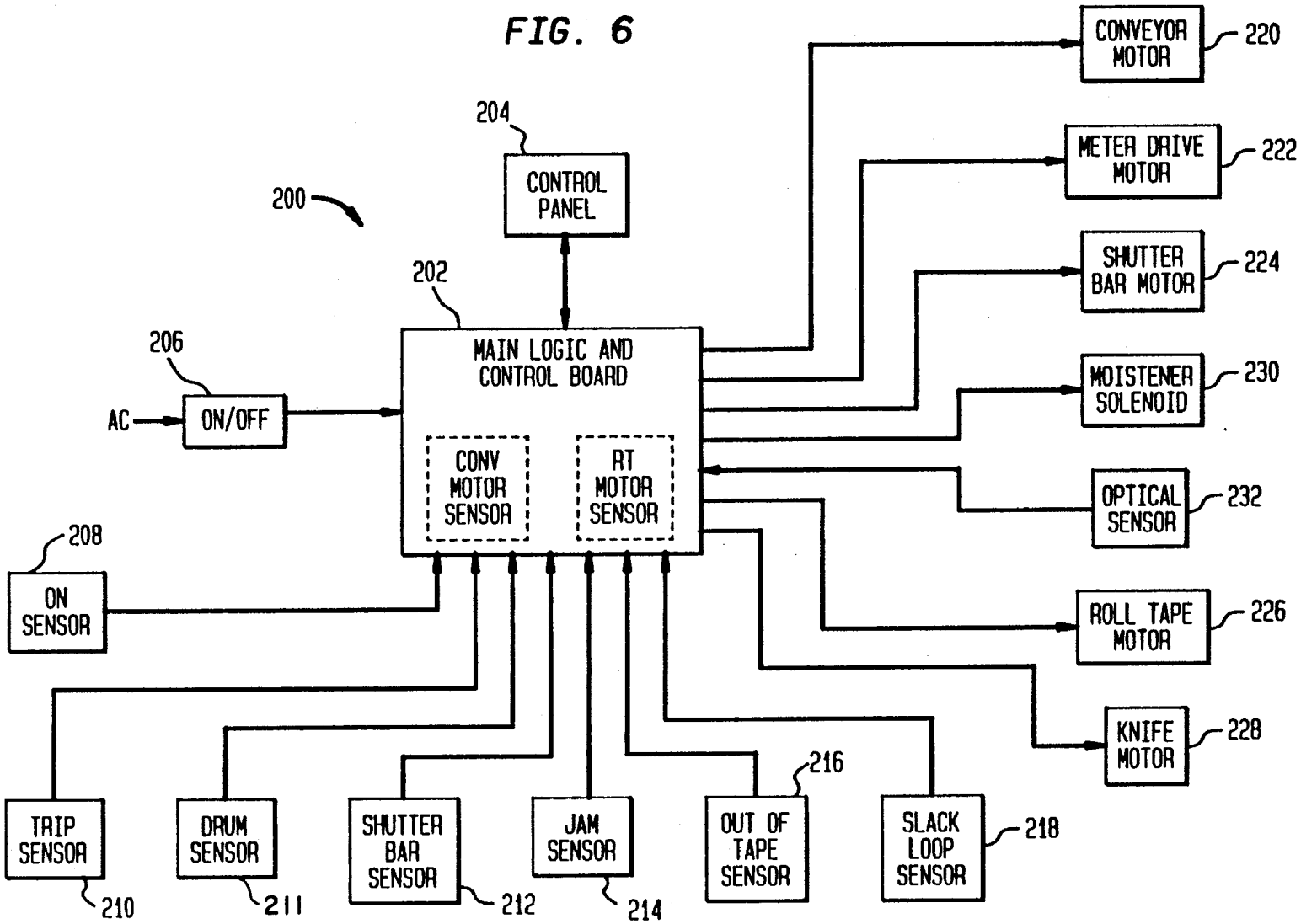
FIG. 6 is a schematic block diagram of the electronic components of the mailing machine.

FIG. 6 is a circuit block diagram of the mailing machine. As seen generally at 200, the main logic and control board 202 receives information from a control panel 204 when A/C power has been applied via on/off switch 206. Various sensors, such as those illustrated for determining the ON condition, 208; trip sensor, 210; drum sensor, 211; shutter bar sensor, 212; jam sensor, 214; out-of-tape sensor, 216; and slack loop sensor, 218 provide information to the control board 202 about the state of the machine while the board outputs information for driving the various motors and solenoids. These motors are the conveyor motor, 220; the meter drive motor, 222; the shutter bar motor, 224; the roll tape drive motor, 226; and the knife motor, 228. The board also provides control information to the moistener solenoid 230 and receives optical count data indicated here at block 232 from an optical sensor and slotted rotating disc operatively connected to the roll tape motor.

Figure 7A:
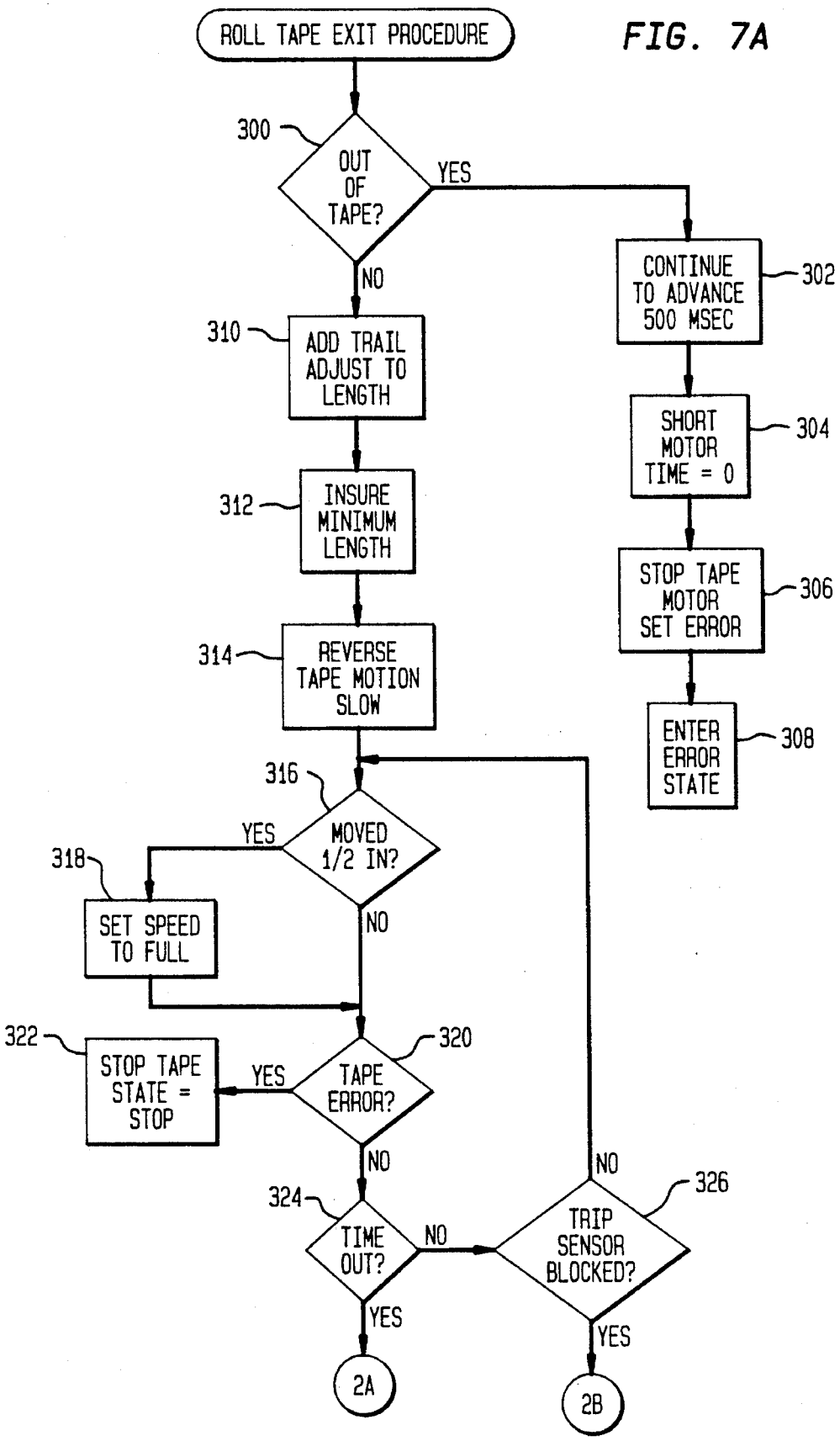

FIGS. 7*a* through 7*d* comprise a flow chart of the exit sequence in accordance with the invention for the tape feeding, cutting, and ejecting apparatus of the mailing machine. As seen in FIG. 7*a*, a check is first made at decision block 300 for an out of tape condition. If YES, the advance of the tape is continued for 500 msec, block 302, and the tape motor is shorted to brake it, at block 302, in accordance with a predetermined time, block 304, an error is set, block 306, and an error state is entered, block 308.

If there is no out of tape condition, the routine adds a trail edge margin, block 310. For example, if the tape length would be less than 2.6 inches, e.g. the distance between rollers, the length is set to 2.6 inches. The minimum length is set, block 312, and the tape motor is reversed to drive at slow speed, block 314. A check is made to determine movement, block 316, and if YES, the speed is set to full, block 318. A check is made at block 320 and if there is a tape error, e.g. the tape is stopped, an error condition is flagged, block 322.

A predetermined timeout is checked, block 324, and if it has not been reached a check is made to determine whether the trip sensor is unblocked, block 326. If it is then the routine loops to continue driving. Typically, the timeout is set at 600 msec, so that if the trip sensor has not been unblocked it is assumed that there is a jam and the tape is now advanced for several inches in an attempt to release the bind, if the trip sensor is unblocked the routine proceeds directly to block 350 of FIG. 7*b*. As seen in FIG. 7*b*, the YES branch from block 324, the motor is braked, block 328, and the motor is driven in the forward direction for 100 msec, block 330, and then braked again at block 332, and reversed at block 334. At this point, if a tape error is detected, block 336, the tape motor is stopped, block 338, and a State= Stopped is set. Next a timeout check is made, block 340, and if it is reached, the tape motor is shorted, block 342, advanced again for 100 msec, block 344, and then shorted again, block 346, and thereafter the cut tape is ejected as being too long. If the trip sensor has not become unblocked before timeout, block 348, the routine loops back and if it has, the routine proceeds to block 350 for braking the motor and a check is then made at block 352 to determine whether the tape is longer than a predetermined amount, for example 3⅞ inches, which is related to the distance from the trip sensor to the cutting knife. If the desired length is greater than this amount the tape is run forward, block 354, otherwise it is reversed the appropriate distance, block 356. This operation is preferably performed at ¼ of full speed in order to minimize slippage.

At this point the tape motor is shorted, block 358, and the knife motor started. Details of the operation of the knife control may be found in Application Ser. No. 08/203,132 herewith specifically incorporated by reference herein. The knife motor is operated in a forward direction, block 360, for approximately 14 msec and then reversed for 4 msec, block 362, and halted at block 364, and homed for approximately 20 msec, block 366. The knife is held then while the tape drive motor is reversed, block 368.

Figure 7C:
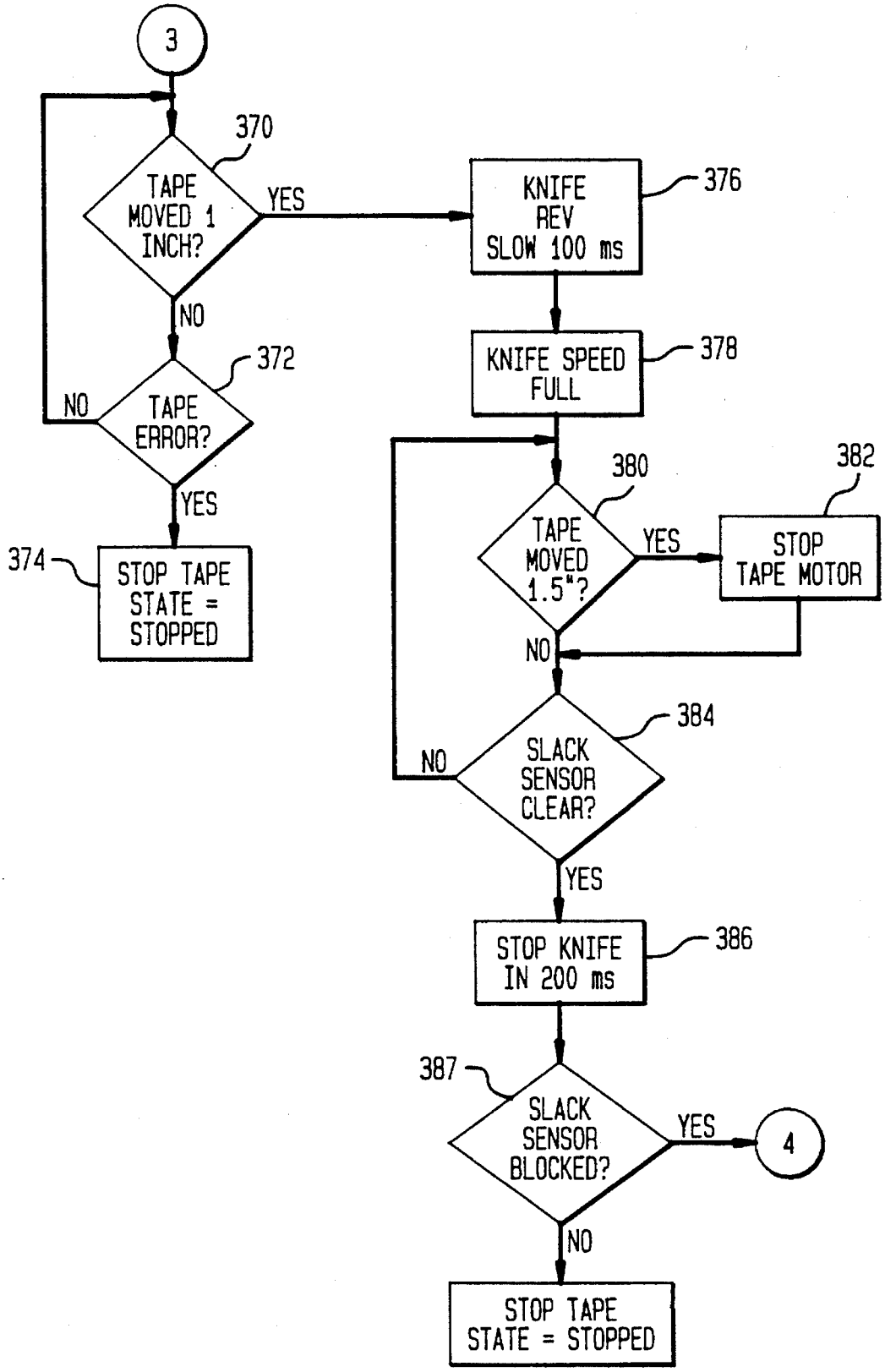

Turning now to FIG. 7*c*, the routine falls from block 368 to block 370 for determining whether the tape has moved 1-inch. If not, a tape error is detected, block 372, and if it has occurred the tape is stopped, block 374, and the stop tape condition is flagged. If the tape has moved, the knife motor is reversed, block 376, and as described above begins to drive the exit rollers for ejecting the cut tape, block 378. After a fixed distance, for example, 1.5 inches, as detected at block 380, the tape motor is stopped, block 382, to prevent the roll tape from leaving the drive rollers.

Figure 7D:
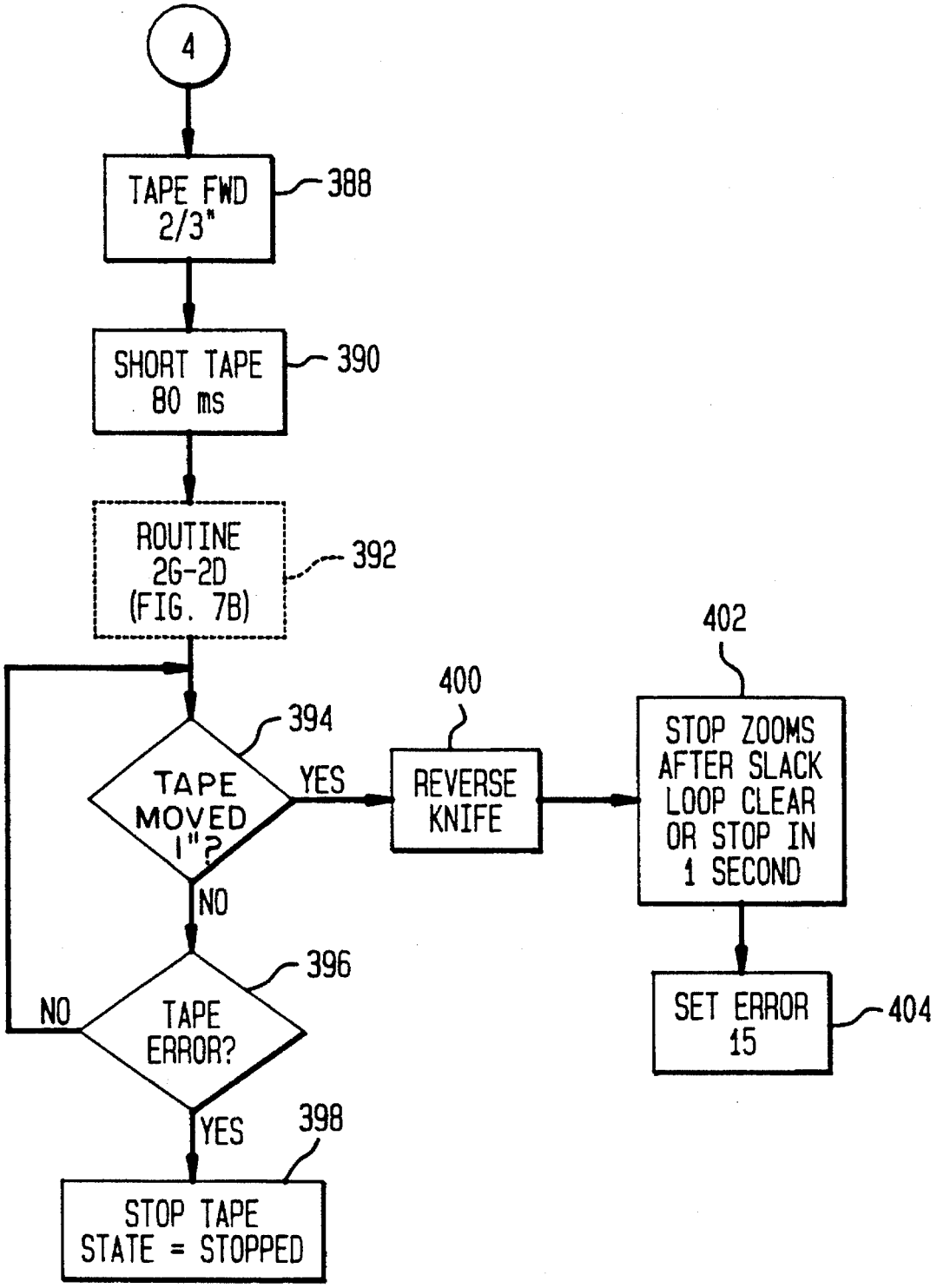

If the slack sensor is not blocked, block 384, the tape motor is stopped and the condition is set, block 386. As seen in FIG. 7*d*, if the slack sensor remains blocked, a retry is attempted. The tape motor again attempts to drive the roll tape forward for approximately ⅔ inch, block 388, and then brakes, block 390. The knife motor drive routine indicated at 2G- 2D of FIG. 7*d* is again called, block 392, and the movement is determined, block 394.

If a tape error is noted, block 396, the tape motor is stopped and the condition set, block 398. If the tape has moved, the YES path from block 394 falls to block 400 to reverse the knife motor and is stopped 500 msec after the slack loop sensor is cleared or after 1 sec, block 402. An error is posted, block 404, whether or not this retry works since reversing the motor a second time causes the tape to leave the feed rollers.

It will be appreciated that as described herein the method in accordance with the invention enables the tape ejection to avoid many of the possible jam conditions associated with the drive mechanisms disclosed.

What is claimed is:

1. A method for sequencing the exiting of a cut tape segment from a tape roll feeding, cutting and ejecting apparatus of a mailing machine having a tape roll drive for feeding the tape in a feeding direction for printing and cut tape segment ejection means in which the cut tape segment from the tape roll is ejected in an opposite direction from the feeding direction, the method comprising the steps of feeding the tape in the feeding direction for a first predetermined time period for extending a predetermined length of tape, further feeding the tape in the feeding direction to create a trail edge margin to assure that the tape is not cut shorter than a minimum length, printing on the tape; then feeding the tape in the opposite direction until one of a first and second conditions occurs, the first condition being the sensing of a leading edge of the tape by a sensor and the second condition being feeding the tape in the opposite direction beyond a second predetermined time period; then at times when the first condition occurs cutting the tape with a cutting apparatus to create the cut tape segment and subsequently ejecting the tape segment from the tape roll feeding, cutting and ejecting apparatus, and at times when the second condition occurs feeding the tape in the tape feed direction to alleviate a tape jam condition.

2. The method of claim 1 wherein the sensor is a trip sensor.

3. The method of claim 2 wherein the trip sensor and the cutting apparatus are separated by a fixed distance, and at times when a desired length of the cut tape segment is greater than the fixed distance and the first condition has occurred the tape is fed in the feeding direction an amount equal to a difference between the fixed distance and the desired length prior to cutting of the tape and at times when the desired length of the cut tape segment is less than the fixed distance and the first condition has occurred the tape is fed in the opposite direction the amount equal to the difference between the fixed distance and the desired length prior to cutting of the tape.

* * * * *